US011098898B2

(12) United States Patent
Buescher et al.

(10) Patent No.: US 11,098,898 B2
(45) Date of Patent: Aug. 24, 2021

(54) AUTOMATIC PILOT LIGHTING SYSTEMS

(71) Applicant: EMERSON ELECTRIC CO., St. Louis, MO (US)

(72) Inventors: Thomas P. Buescher, Webster Groves, MO (US); Daniel L. Furmanek, Ballwin, MO (US); Ryan Jensen, St. Louis, MO (US)

(73) Assignee: EMERSON ELECTRIC CO., St. Louis, MO (US)

( * ) Notice: Subject to any disclaimer, the term of this patent is extended or adjusted under 35 U.S.C. 154(b) by 135 days.

(21) Appl. No.: 16/571,441

(22) Filed: Sep. 16, 2019

(65) Prior Publication Data

US 2020/0103110 A1 Apr. 2, 2020

Related U.S. Application Data

(60) Provisional application No. 62/738,702, filed on Sep. 28, 2018.

(51) Int. Cl.
*F23Q 9/04* (2006.01)
*F23N 5/20* (2006.01)
(Continued)

(52) U.S. Cl.
CPC ..... *F23Q 9/04* (2013.01); *F23N 5/203* (2013.01); *F23N 5/24* (2013.01); *F23N 2227/36* (2020.01); *F23N 2241/04* (2020.01)

(58) Field of Classification Search
CPC .. F23N 1/002; F23N 2223/08; F23N 2227/02; F23N 2227/36; F23N 2229/02;
(Continued)

(56) References Cited

U.S. PATENT DOCUMENTS 2,544,454 A * 3/1951 Gauger ..... 431/57
3,295,583 A * 1/1967 Ambrose ..... F23N 5/22 431/29
(Continued)

FOREIGN PATENT DOCUMENTS

DE 2500557 A1 * 7/1976 ..... F23Q 9/14
EP 454613 A1 * 11/1991
(Continued)

*Primary Examiner* — Jorge A Pereiro
*Assistant Examiner* — Logan P Jones
(74) *Attorney, Agent, or Firm* — Harness, Dickey & Pierce, P.L.C.; Anthony G. Fussner

(57) ABSTRACT

An automatic pilot lighting system for unattended automatic lighting of a standing pilot may include a powered (e.g., battery powered, etc.) circuit. The powered circuit may include an analog timer circuit including a timer switch. A spark ignitor may be coupled with the timer switch. A temperature knob pilot momentary switch may be coupled with the timer switch. An ON/OFF switch may be coupled with the temperature knob pilot momentary switch and the timer switch. The ON/OFF switch may be configured to be operable for selectively disabling and enabling a power source. The analog timer circuit may be configured to be selectively activatable for applying voltage from the power source via the ON/OFF switch for pilot hold voltage and spark ignition for an amount of time sufficient to allow for unattended automatic lighting of the standing pilot and sufficient voltage generation to support standalone operation.

12 Claims, 2 Drawing Sheets

(51) Int. Cl.
*F23N 5/24* (2006.01)
*F23N 5/10* (2006.01)
*F23N 1/00* (2006.01)

(58) Field of Classification Search
CPC ..... F23N 2241/04; F23N 5/102; F23N 5/203; F23N 5/24; F23N 5/242; F23Q 9/04
See application file for complete search history.

(56) References Cited

U.S. PATENT DOCUMENTS 4,131,413 A 12/1978 Ryno
5,636,978 A 6/1997 Sasaki
5,816,791 A * 10/1998 Home ..... F23N 5/102 431/46
5,931,655 A * 8/1999 Maher, Jr. ..... F23N 5/102 431/14
5,954,265 A * 9/1999 Hall ..... F24H 9/2035 236/94
7,702,369 B1 * 4/2010 Wright ..... H04B 1/3833 455/571
9,410,719 B2 8/2016 Furmanek et al.
9,568,196 B2 2/2017 Furmanek et al.
9,574,793 B2 2/2017 Furmanek et al.
9,599,369 B2 3/2017 Furmanek et al.
2002/0009296 A1 * 1/2002 Shaper ..... G03B 15/05 396/56
2003/0128128 A1 * 7/2003 Alrabady ..... B60C 23/0408 340/672
2010/0075264 A1 3/2010 Kaplan et al.
2010/0192939 A1 * 8/2010 Parks ..... F23N 1/002 126/39 BA
2010/0236538 A1 * 9/2010 Wah ..... F23N 5/105 126/39 BA
2013/0104814 A1 5/2013 Reyman
2015/0276268 A1 10/2015 Hazzard et al.

FOREIGN PATENT DOCUMENTS

GB 2013867 A 8/1979
JP 52121831 A * 10/1977 ..... F23N 5/102
JP 52169132 U * 12/1977

* cited by examiner

AUTOMATIC PILOT LIGHTING SYSTEMS

CROSS-REFERENCE TO RELATED APPLICATION

This application claims the benefit and priority of U.S. Provisional Application No. 62/738,702 filed Sep. 28, 2018, which is incorporated herein by reference in its entirety.

FIELD

The present disclosure generally relates to automatic pilot lighting systems and powered circuits for such automatic pilot lighting systems.

BACKGROUND

This section provides background information related to the present disclosure which is not necessarily prior art.

Atmospheric water heaters are standalone appliances that do not typically have power supplied. Instead, power comes from a pilot generator that must be manually started. But opening a valve and pressing a spark ignitor tends to make many operators nervous due to the fear of a delayed ignition.

DRAWINGS

The drawings described herein are for illustrative purposes only of selected embodiments and not all possible implementations, and are not intended to limit the scope of the present disclosure.

Corresponding reference numerals indicate corresponding (though not necessarily identical) parts throughout the several views of the drawings.

DETAILED DESCRIPTION

Example embodiments will now be described more fully with reference to the accompanying drawings.

As explained above in the background, atmospheric water heaters are standalone appliances that do not typically have power supplied. Instead, power comes from a pilot generator that must be manually started. But opening a valve and pressing a spark ignitor tends to make many operators nervous due to the fear of a delayed ignition.

Conventionally, a user must hold a pilot valve open and ignite the gas until enough electrical current is generated by the thermopile for holding the pilot valve open. The user may then release the pilot valve, which remains open after being released by the user as the pilot valve is held open by the electrical current generated by the thermopile. On a conventional mechanical valve, however, there is no way for a user to know when the thermopile has generated sufficient electrical current to hold the pilot valve open. Thus, a user will typically hold the valve open until the user predicts that a sufficient amount of time has passed for the thermopile to generate a sufficient electrical current for holding the pilot valve open. The user may thereafter release the pilot valve.

Newer pilot operated gas controls are electronic and have an LED, which illuminates when sufficient electrical power has been provided for holding a pilot valve open. Accordingly, the LED may thus be illuminated to indicate to the user that the pilot valve may be released and remain open as the pilot valve will be held open via the electrical power.

Even with conventional electronic pilot operated gas controls (e.g., electronic water heater controls, etc.), a user must still manually hold open the pilot valve to initiate operation. And if there is a quantity of air in the supply line to the gas valve, a user may have to manually hold the valve open for quite a while before enough air has been purged from the supply line such that the gas will ignite. This is fairly typical for a new installation of a water heater or when an existing water heater is replaced.

Accordingly, disclosed herein are exemplary embodiments of automatic pilot lighting systems that include battery powered circuits. In exemplary embodiments, a battery powered circuit may be configured to be operable independently of a conventional electronic pilot operated gas control circuit. The battery powered circuit may include an analog timer circuit configured to apply a voltage for the pilot hold voltage, spark ignition, and LED indication for an appropriate time (e.g., 90 seconds, etc.) to allow for lighting the pilot and enough voltage generation to support standalone operation. Advantageously, exemplary embodiments disclosed herein include battery powered circuits that may be configured for enabling a user to initiate an unattended automated lighting of a standing pilot burner on a gas fired storage water heater.

Figure 1:
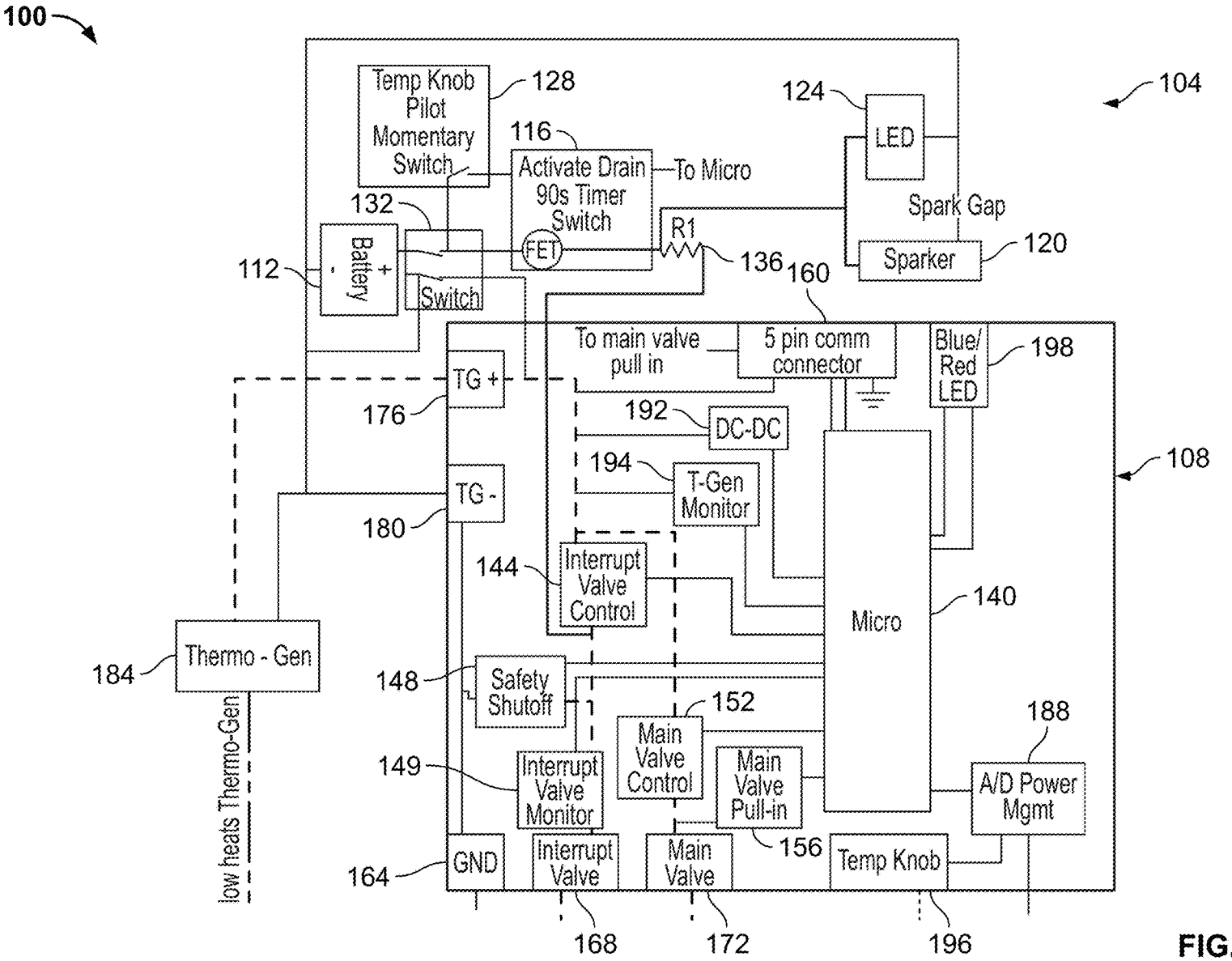
FIG. 1 is a block diagram of an analog version of an automatic pilot lighting system according to an exemplary embodiment of the present disclosure.

With reference now to the figures, FIG. 1 illustrates an exemplary embodiment of an analog version of an automatic pilot lighting system 100 embodying one or more aspects of the present disclosure. The automatic pilot lighting system 100 generally includes a battery powered circuit 104 coupled with or added to a gas valve assembly 108 (e.g., an existing NGA valve, etc.).

In this exemplary embodiment, the circuit 104 is battery powered and operates independently of the micro controlled circuit 108 (e.g., NGA circuit, conventional electronic pilot operated gas control circuit, etc.). An analog timer circuit applies a voltage for pilot hold, spark, and LED indication for an appropriate time (e.g., 90 seconds, etc.) to allow for lighting the pilot and enough voltage to support standalone operation.

As shown in FIG. 1, the circuit 104 includes a battery 112, the analog timer circuit including a timer switch 116 (e.g., a 90-second timer switch, etc.), a sparker or spark ignitor 120, an LED 124, a temperature knob pilot momentary switch 128, a switch 132 (e.g., a double pole single throw switch, etc.), and a resistor R1 136 (e.g., resistor having a resistance of 8 Ohms, etc.). A spark gap is shown between the sparker 120 and ground. The timer switch 116 includes a field effect transistor (FET). The timer switch 116 is electrically connected via a terminal (activate) to the temperature knob pilot momentary switch 128. The timer switch 116 is also electrically connected via a terminal (drain) to a microcontroller 140 so that the microcontroller 140 can deactivate the timer switch 116. Although FIG. 1 shows a 90-second timer switch 116 and a single battery 112 for powering the circuit 104, other exemplary embodiments may include a timer switch having a duration longer or shorter than 90 seconds and/or more than one battery for powering the circuit.

With continued reference to FIG. 1, the gas valve assembly 108 includes a microcontroller 140, an interrupt valve control 144, an interrupt valve monitor 149, a safety shutoff 148, a main valve control 152, and a main valve pull-in 156. The gas valve assembly 108 also includes a connector 160 (e.g., 5 pin comm connector, etc.), a ground 164, an interrupt valve 168, a main valve 172, and positive (TG+) and negative (TG−) terminals 176, 180 coupled to a thermoelectric generator (TG) 184. The gas valve assembly 108 further includes analog to digital power management 188, a DC-DC power supply 192, a thermoelectric generator monitor (T-Gen Monitor) 194, a temperature control knob 196, and an LED 198 (e.g., blue/red LED, etc.). Alternative embodiments may include a differently configured valve assembly, e.g., with different components, additional components, etc. Accordingly, aspects of the present disclosure should not be limited to use with only the specific gas valve assembly 108 shown in FIG. 1. For example, FIG. 1 generally shows the automatic pilot lighting system 100 for a water heater, but other exemplary embodiments may be used on or with any self-powered pilot operated device, such as a gas fireplace, space heater, etc.

A description of an exemplary analog method of operation for the automatic pilot lighting system 100 will now be provided for purpose of illustration only. In a first step or process, an operator turns the On/Off switch 132 to on, which removes the grounding 164 of the positive thermogenerator terminal (TG+) 176 and enables the battery 112.

In a second step or process, the operator moves the knob of the temperature knob pilot momentary switch 128 to pilot and presses and releases the knob of the temperature knob pilot momentary switch 128. The LED indicator 124 turns on. This action will manually push the interrupt valve to close the magnetic circuit and actuate a momentary switch of the temperature knob pilot momentary switch 128, to thereby apply voltage to and activate the timer switch 116. Once activated, the timer switch 116 will apply voltage to the coil, the LED 124, and the sparker 120. The voltage applied to the coil will hold the coil such that the pilot valve is held open and remains open. The voltage applied to the LED 124 will cause the LED 124 to illuminate and thereby indicate the circuit 104 is in operation. The voltage applied to the sparker 120 will cause the sparker 120 to apply a spark at the pilot to light the gas.

In the single battery design shown in FIG. 1, the FET of the timer switch 116 is not fully turned on, but is in a linear range because voltage at the gate and source are similar. In this example, there is sufficient voltage (e.g., 0.7 volts, etc.) available to hold the valve open. There may also be sufficient voltage for operating the spark ignitor 120 depending on the configuration of the spark ignitor 120. In other exemplary embodiments, more than one battery is used (e.g., two batteries, etc.) such that the FET of the timer switch 116 may be fully turned thereby providing sufficient voltage (e.g., about 1.5 volts, etc.) for operating the spark ignitor 120.

In a third step or process, the spark ignitor 120 sparks at constant rate (e.g., 1-4 hz, etc.) lighting the pilot. The pilot starts supplying power via the thermogenerator 184. The thermogenerator voltage starts to rise due to the heat from the pilot flame. The DC-DC power supply 192 starts. When there is sufficient voltage output, the microcontroller 140 starts. The microcontroller 140 will see a relatively low voltage at the T-gen Monitor 294 (e.g., <300 mV, etc.). The microcontroller 140 will see a relatively large voltage on the interrupt valve monitor 149 (e.g., 700+m V, etc.). This indicates that the microcontroller 140 is starting by the automatic pilot lighting system 100. When the microcontroller 140 sees the thermogenerator voltage reach a specific threshold (e.g., 300+mV, etc.), the microcontroller 140 knows the microcontroller 140 can operate without the battery 112, and in response, the microcontroller 140 turns on the pilot interrupt valve control 144, blinks the micro controlled LED 198 indicating that the pilot is successfully lit, and deactivates the 90*s* timer switch 116. Deactivating the 90*s* timer switch 116 will also turn off the initial LED 124 and sparker 120.

The valve assembly 108 may include safety checks for the system 100. By way of example, the valve assembly 108 may include safety checks and responses similar to or the same as the safety checks and responses disclosed in U.S. Pat. No. 9,568,196, the contents of which is incorporated herein by reference in its entirety.

With further reference to FIG. 1, the microcontroller 140 checks the interrupt valve monitor 149 before turning on the main burner gas flow via the main valve control 152 and main valve pull In 156. The microcontroller 140 reduces the voltage on the gate of the FET in the interrupt valve control 144 until the interrupt valve control 144 starts to reduce the voltage to the interrupt valve 168. The microcontroller 140 can see this reduction in voltage from the interrupt valve monitor 149. If the battery 112 is supplying power to the interrupt valve 168, the microcontroller 140 will not see a drop in voltage, and the microcontroller 140 will not turn on main gas flow. Additionally, if the timer switch 116 fails to close during a call for heat, the safety shutoff 148 will short the interrupt valve's 168 voltage supply to ground 164 for a time period (e.g., 100 mS, etc.) that will cause the interrupt valve 168 to return to its normally closed position. After this time period, voltage will again be across the interrupt valve 168, but the voltage is not enough to change the state of the interrupt valve 168 to open, because the interrupt valve 168 requires a manual press from the user to close the magnetic circuit and hold open the interrupt valve 168.

Figure 2:
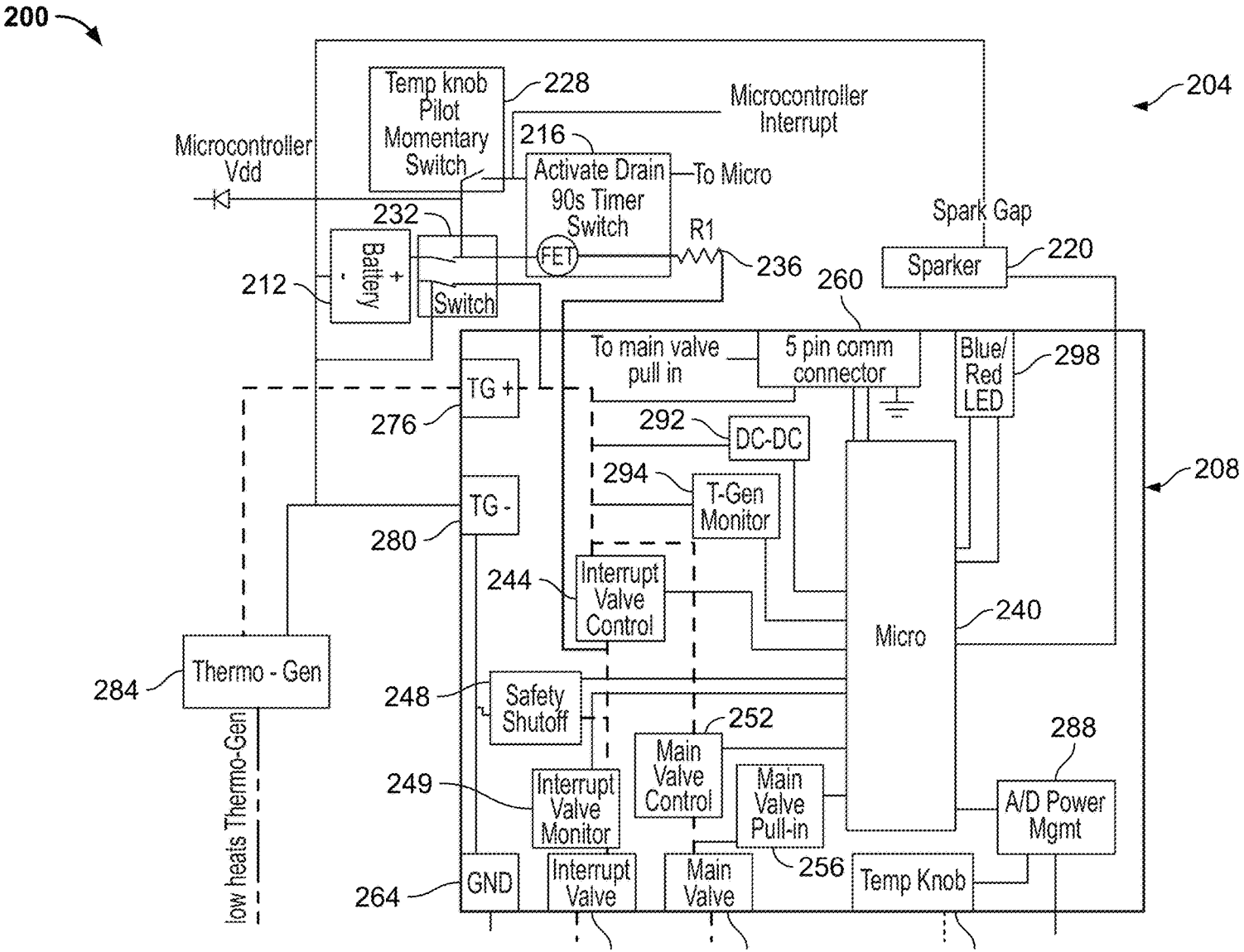
FIG. 2 is a block diagram of a microcontroller managed version of an automatic pilot lighting system according to another exemplary embodiment of the present disclosure.

The analog method described above for the automatic pilot lighting system 100 could also be managed by a microcontroller as an alternate method (e.g., a method of operating the automatic pilot lighting system 200 shown in FIG. 2, etc.). In this alternative method, when the on/off switch is in the on position, the microcontroller is powered in a deep sleep state. When the pilot knob press actuates the momentary switch, the momentary switch provides an interrupt rising edge to wake up the microcontroller in addition to activating the timer switch. The timer switch enables the instant hold of the interrupt valve. The microcontroller controls the spark circuit and the LED indication. The microcontroller operates off the battery voltage until the DC-DC power supply voltage is higher than the battery output or until the microcontroller detects that the thermogenerator voltage has risen to a sufficient level and the battery is no longer needed. A low voltage drop Schottky diode may be used to prevent charging of the battery by the thermogenerator (T-gen) powered DC-DC power supply.

In the method described above, the momentary switch provides an interrupt rising edge to wake up the microcontroller 140 when the pilot knob press actuates the momentary switch. But this method may also be performed without any interrupt. Instead, the method could poll an input or set of inputs. The microcontroller could automatically pop out of deep sleep periodically and check the state of the timer switch for instance or the state of the generator volt monitor and interrupter monitor. The voltages present for instance at the generator volt monitor and interrupt monitor could give an indication to the microcontroller that the pilot is being held open by the battery. This polling would occur relatively quickly or fast enough (e.g., every 2 seconds, etc.) such that the pilot valve is not open too long before detecting the open pilot valve. But as it may be preferably to have the microcontroller sleeping as much as possible so as not to drain the battery during this time, the method described above with an interrupt may be a preferable solution.

FIG. 2 illustrates an exemplary embodiment of a microcontroller managed version of an automatic pilot lighting system 200 embodying one or more aspects of the present disclosure. The automatic pilot lighting system 200 generally includes a battery powered circuit 204 coupled with or added to a gas valve assembly 208 (e.g., an existing NGA valve, etc.).

As shown in FIG. 2, the circuit 204 includes a battery 212, a timer switch 216 (e.g., a 90-second timer switch, etc.), a sparker or spark ignitor 220, a temperature knob pilot momentary switch 228, a switch 232 (e.g., a double pole single throw switch, etc.), and a resistor R1 236 (e.g., resistor having a resistance of 8 Ohms, etc.). The timer switch 216 includes a field effect transistor (FET). The timer switch 216 is electrically connected via a terminal (activate) to the temperature knob pilot momentary switch 228. Although FIG. 2 shows a 90-second timer switch 216 and a single battery 212 for powering the circuit 204, other exemplary embodiments may include a timer switch having a duration longer or shorter than 90 seconds and/or more than one battery for powering the circuit.

With continued reference to FIG. 2, the gas valve assembly 208 includes a microcontroller 240, an interrupt valve control 244, an interrupt valve monitor 249, a safety shutoff 248, a main valve control 252, and a main valve pull-in 256. The gas valve assembly 208 also includes a connector 260 (e.g., 5 pin comm connector, etc.), a ground 264, an interrupt valve 268, a main valve 272, and positive (TG+) and negative (TG−) terminals 276, 280 coupled to a thermoelectric generator (TG) 284. The gas valve assembly 208 further includes analog to digital power management 288, a DC-DC power supply 292, a thermoelectric generator monitor (T-Gen Monitor) 294, a temperature control knob 296, and an LED 298 (e.g., blue/red LED, etc.). Alternative embodiments may include a differently configured valve assembly, e.g., with different components, additional components, etc. Accordingly, aspects of the present disclosure should not be limited to use with only the specific gas valve assembly 208 shown in FIG. 2. For example, FIG. 2 generally shows the automatic pilot lighting system 200 for a water heater, but other exemplary embodiments may be used on or with any self-powered pilot operated device, such as a gas fireplace, space heater, etc.

A description of an exemplary microcontroller managed method of operation for the automatic pilot lighting system 200 will now be provided for purpose of illustration only. In a first step or process, an operator turns the On/Off switch 232 to on, which removes the grounding 264 of the positive thermogenerator terminal (TG+) 276 and enables the battery 212. When the On/Off switch 232 is in the on position, the microcontroller 240 is powered in a deep sleep state.

In a second step or process, the operator moves the knob 228 to pilot and presses and releases the knob 228. This action will manually push the interrupt valve to close the magnetic circuit and actuate a momentary switch of the temperature knob pilot momentary switch 228. When the pilot knob press actuates the momentary switch, the momentary switch provides an interrupt rising edge to wake up the microcontroller 240 in addition to activating the timer switch 216. The timer switch 216 enables the instant hold of the interrupt valve 268.

The microcontroller 240 controls the spark circuit and the illumination of the LED 298. The microcontroller 240 operates off the voltage of the battery 212 until the voltage of the DC-DC power supply 292 is higher than the battery output. A low voltage drop Schottky diode may be used to prevent charging of the battery 212 by the thermogenerator (T-gen) powered DC-DC power supply 292.

In a third step or process, the spark ignitor 220 sparks at constant rate (e.g., 1-4 hz, etc.) lighting the pilot. The pilot starts supplying power via the thermogenerator 284. The thermogenerator voltage starts to rise due to the heat from the pilot flame. The DC-DC power supply 292 starts. The microcontroller 240 will see a relatively low voltage at the T-gen Monitor 294 (e.g., <300 mV, etc.). The microcontroller 240 will see a relatively large voltage on the interrupt valve monitor 249 (e.g., 700+m V, etc.). This indicates that the microcontroller 240 is starting by the automatic pilot lighting system 200. When the microcontroller 240 sees the thermogenerator voltage reach a specific threshold (e.g., 300+mV, etc.), the microcontroller 240 knows the microcontroller 240 can operate without the battery 212, and in response, the microcontroller 240 turns on the pilot interrupt valve control 244, blinks the micro controlled LED 298 indicating that the pilot is successfully lit, and deactivates the 90*s* timer switch 216. Deactivating the 90*s* timer switch 216 will also turn off the sparker 220.

The valve assembly 208 may include safety checks for the system 200. By way of example, the valve assembly 208 may include safety checks and responses similar to or the same as the safety checks and responses disclosed in U.S. Pat. No. 9,568,196, the contents of which is incorporated herein by reference in its entirety.

With further reference to FIG. 2, the microcontroller 240 checks the interrupt valve monitor 249 before turning on the main burner gas flow via the main valve control 252 and main valve pull In 256. The microcontroller 240 reduces the voltage on the gate of the FET in the interrupt valve control 244 until the interrupt valve control 244 starts to reduce the voltage to the interrupt valve 268. The microcontroller 240 can see this reduction in voltage from the interrupt valve monitor 249. If the battery 212 is supplying power to the interrupt valve 268, the microcontroller 240 will not see a drop in voltage, and the microcontroller 240 will not turn on main gas flow. Additionally, if the timer switch 216 fails to close during a call for heat, the safety shutoff 248 will short the interrupt valve's 268 voltage supply to ground 264 for a time period (e.g., 100 mS, etc.) that will cause the interrupt valve 268 to return to its normally closed position. After this time period, voltage will again be across the interrupt valve 268, but the voltage is not enough to change the state of the interrupt valve 268 to open, because the interrupt valve 268 requires a manual press from the user to close the magnetic circuit and hold open the interrupt valve 268.

In the method described above, the momentary switch provides an interrupt rising edge to wake up the microcontroller 240 when the pilot knob press actuates the momentary switch. But this method may also be performed without any interrupt. Instead, the method could poll an input or set of inputs. The microcontroller could automatically pop out of deep sleep periodically and check the state of the timer switch for instance or the state of the generator volt monitor and interrupter monitor. The voltages present for instance at the generator volt monitor and interrupt monitor could give an indication to the microcontroller that the pilot is being held open by the battery. This polling would occur relatively quickly or fast enough (e.g., every 2 seconds, etc.) such that the pilot valve is not open too long before detecting the open pilot valve. But as it may be preferably to have the microcontroller sleeping as much as possible so as not to drain the battery during this time, the method described above with an interrupt may be a preferable solution.

Advantageously, exemplary embodiments disclosed herein (e.g., FIG. 1, FIG. 2, etc.) may be configured to allow for unattended automatic lighting of a standing pilot burner on a gas storage water heater, an atmospheric water heater, gas logs for a fireplace, among other appliances and devices having pilot operated gas controls, etc.

A conventional electronic water heater control having a standing pilot may include an externally powered full sequence ignition controller based burner system that requires a 120V outlet near the water heater. Also, a conventional manual pilot lighting sequence may also be used for lighting a standing pilot of an electronic water heater control. But people unfamiliar with the appliance may find it difficult to follow and/or become nervous when following the manual pilot lighting sequence. Conventional solutions may include the use of a battery and control circuit to light an intermittent pilot using a spark. But such conventional solutions do not include a circuit as disclosed herein, such as the battery powered circuit shown in FIG. 1 (analog version) or FIG. 2 (microcontroller managed version). Conventional solutions do not include a sequence of operation for unattended automated lighting of a standing pilot as disclosed herein.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. For example, when permissive phrases, such as "may comprise", "may include", and the like, are used herein, at least one embodiment comprises or includes the feature(s). As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or, for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An automatic pilot lighting system for unattended automatic lighting of a standing pilot, the automatic pilot lighting system comprising a powered circuit including an analog timer circuit configured to apply a voltage from a power source for pilot hold voltage and spark ignition for an amount of time sufficient to allow for unattended automatic lighting of the standing pilot and sufficient voltage generation to support standalone operation;

wherein the analog timer circuit includes a timer switch, and wherein the powered circuit includes:

a spark ignitor coupled with the timer switch;

a temperature knob pilot momentary switch coupled with the timer switch; and an ON/OFF switch coupled with the temperature knob pilot momentary switch and the timer switch; and wherein the ON/OFF switch comprises a double pole single throw switch including:

a first pole including a first input terminal configured to be coupled with the power source and a first output terminal coupled with the timer switch and the temperature knob pilot momentary switch; and a second pole including a second input terminal configured to be coupled with the power source and a second output terminal configured to be coupled with a controller of a gas valve assembly.

2. The automatic pilot lighting system of claim 1, wherein the ON/OFF switch is configured to allow a user to selectively enable and disable the power source of the powered circuit, and wherein the analog timer circuit is configured to be selectively activatable for applying voltage from the power source via the ON/OFF switch to:

a coil for holding a pilot valve open; and the spark ignitor for operating the spark ignitor to apply a spark at the standing pilot.

3. The automatic pilot lighting system of claim 1, wherein:

the powered circuit includes a resistor coupled with the timer switch; and/or the timer switch includes a field effect transistor coupled with the ON/OFF switch and the spark ignitor.

4. The automatic pilot lighting system of claim 1, wherein:

the timer switch includes a first terminal coupled with the temperature knob pilot momentary switch, whereby actuation of the temperature knob pilot momentary switch allows voltage from the power source to be applied to the timer switch to thereby activate the timer switch; and the timer switch includes a second terminal configured to be coupled with a controller of a gas valve assembly, whereby the controller is capable of deactivating the timer switch to thereby turn off the spark ignitor.

5. The automatic pilot lighting system of claim 1, wherein the powered circuit further includes one or more light sources coupled with the timer switch and configured to illuminate for indicating operation of the powered circuit when the analog timer circuit applies voltage to the one or more light sources from the power source via the ON/OFF switch.

6. The automatic pilot lighting system of claim 1, wherein the power source of the powered circuit includes one or more batteries operable for providing the voltage applied by the analog timer circuit for pilot hold voltage and spark ignition.

7. The automatic pilot lighting system of claim 1, wherein:

the power source of the powered circuit is a single battery operable for providing the voltage applied by the analog timer circuit for pilot hold voltage and spark ignition independent of a power source of a controller of a gas valve assembly coupled with the powered circuit;

and/or the analog timer circuit is configured to apply the voltage for pilot hold voltage and spark ignition for an amount of time of at least about 90 seconds.

8. A device comprising the automatic pilot lighting system of claim 1 and a gas valve assembly including a microcontroller and a standing pilot, whereby the automatic pilot lighting system enables a user to initiate unattended automatic lighting of the standing pilot.

9. The device of claim 8, wherein:

the device includes a coil operable for opening and closing a pilot valve;

the analog timer circuit is configured to be selectively activatable for applying voltage from the power source via the ON/OFF switch to:

the coil for holding the pilot valve open; and the spark ignitor for operating the spark ignitor to apply a spark at the standing pilot.

10. The device of claim 9, wherein:

the standing pilot is configured such that after being lit by the spark ignitor, a flame of the standing pilot is operable for applying heat for increasing a voltage of a thermoelectric generator of the device;

the microcontroller is configured to operate from the voltage of the power source of the powered circuit until a voltage of a DC-DC power supply of the device is higher than a voltage output of the power source of the powered circuit and/or until the microcontroller detects that the thermoelectric generator voltage has risen to a specific threshold to allow the microcontroller to be operable without the power source of the powered circuit; and the microcontroller is configured to deactivate the timer switch and thereby turn off the spark ignitor when the thermoelectric generator voltage has reached the specific threshold.

11. A gas fired storage water heater including the automatic pilot lighting system of claim 1 and a gas valve assembly including a microcontroller and a standing pilot, whereby the powered circuit enables a user to initiate unattended automatic lighting of the standing pilot.

12. A device comprising an automatic pilot lighting system and a gas valve assembly including a microcontroller and a standing pilot, the automatic pilot lighting system comprising a powered circuit including an analog timer circuit configured to apply a voltage from a power source for pilot hold voltage and spark ignition for an amount of time sufficient to allow for unattended automatic lighting of the standing pilot and sufficient voltage generation to support standalone operation, whereby the automatic pilot lighting system enables a user to initiate unattended automatic lighting of the standing pilot;

wherein:

the device includes a coil operable for opening and closing a pilot valve;

the analog timer circuit includes a timer switch;

the powered circuit includes:

a spark ignitor coupled with the timer switch;

a temperature knob pilot momentary switch coupled with the timer switch; and an ON/OFF switch coupled with the temperature knob pilot momentary switch and the timer switch;

the analog timer circuit is configured to be selectively activatable for applying voltage from the power source via the ON/OFF switch to:

the coil for holding the pilot valve open; and the spark ignitor for operating the spark ignitor to apply a spark at the standing pilot;

the standing pilot is configured such that after being lit by the spark ignitor, a flame of the standing pilot is operable for applying heat for increasing a voltage of a thermoelectric generator of the device;

the microcontroller is configured to operate from the voltage of the power source of the powered circuit until a voltage of a DC-DC power supply of the device is higher than a voltage output of the power source of the powered circuit and/or until the microcontroller detects that the thermoelectric generator voltage has risen to a specific threshold to allow the microcontroller to be operable without the power source of the powered circuit; and the microcontroller is configured to deactivate the timer switch and thereby turn off the spark ignitor when the thermoelectric generator voltage has reached the specific threshold;

wherein the microcontroller is configured to be powered in a deep sleep state when the ON/Off switch is turned on; and wherein:

the temperature knob pilot momentary switch is configured such that actuation of the temperature knob pilot momentary switch provides an interrupt rising edge to wake up the microcontroller in addition to activating the timer switch; or the microcontroller is configured to automatically wake up from the deep sleep state periodically to poll one or more inputs that are indicative of whether or not the pilot valve is being held open by the powered circuit.

* * * * *